US005875930A

United States Patent [19]

Nakajima et al.

[11] Patent Number: 5,875,930

[45] Date of Patent: Mar. 2, 1999

[54] UNITED TYPE-BEVERAGE DISPENSER

[75] Inventors: Hiromichi Nakajima; Hiroshi Yamamoto; Kazuya Maeda, all of Saitama, Japan

[73] Assignee: Sanyo Electric Co., Ltd., Osaka-fu, Japan

[21] Appl. No.: 827,587

[22] Filed: Mar. 28, 1997

[30] Foreign Application Priority Data

Apr. 2, 1996 [JP] Japan ..... 8-80311

[51] Int. Cl.[6] ..... B67D 5/56

[52] U.S. Cl. ..... 222/129.1; 222/145.5; 222/146.6; 222/214

[58] Field of Search ..... 222/129, 129.1–129.4, 222/94, 105, 132, 146.6, 214, 145.5, 145.6

[56] References Cited

U.S. PATENT DOCUMENTS 4,493,441 1/1985 Sedam et al. ..... 222/129.1
4,856,676 8/1989 Emody ..... 222/129.1 X
4,898,303 2/1990 Large et al. ..... 222/129.1 X
5,353,963 10/1994 Gorski et al. ..... 222/129.1
5,490,614 2/1996 Sardynski ..... 222/129.1
5,797,519 8/1998 Schroeder et al. ..... 222/129.1

*Primary Examiner*—Kevin P. Shaver
*Attorney, Agent, or Firm*—McDermott, Will & Emery

[57] ABSTRACT

A tank unit having a flow rate adjusting mechanism, an electromagnetic valve, a mixer, etc. is disposed in the center of the body of the united type-beverage dispenser, and BIB units having BIBs, peristaltic pumps, nozzles, etc. are disposed on both sides of the tank unit. When the BIBs are removed out of the BIB units, the space for adjusting the flow rate adjusting mechanism and the electromagnetic valve are provided on both side of them, so that the adjustment work for them can be conducted without removing the side plate or top plate of the body.

7 Claims, 6 Drawing Sheets

UNITED TYPE-BEVERAGE DISPENSER

FIELD OF THE INVENTION

The present invention relates to an united type-beverage dispenser, and more specifically, to an united type-beverage dispenser in which the adjustment operation of a pressure tank unit (referred to as "tank unit" hereinafter) can be readily conducted by disposing BIB (Bag In Box) units on both sides of the tank unit.

BACKGROUND OF THE INVENTION

Conventional united type-beverage dispensers have a BIB unit on one side and a tank unit on the opposite side. The raw materials for neutral beverages such as oolong, juice and the like are accommodated in the respective BIBs. Each BIB unit supplies each of the neutral beverages to consumers by delivering an adequate amount of the respective raw materials from BIBS through a nozzle into a cup by a peristaltic pump and diluting the raw material delivered in the cup with an adequate amount of water delivered from another nozzle.

On the other hand, a tank in the tank unit accommodates a strong or weak carbonic acid syrup. The tank unit supplies a syrup beverage to consumers by supplying an adequate amount of the syrup from the tank through a flow regulator and an electromagnetic valve into a mixer and mixing the syrup supplied into the mixer with an adequate amount of diluting water to produce a diluted syrup beverage and delivering the diluted syrup beverage into a cup.

The BIB is a raw material-filled bag accommodated in a box and is improved in the portability, handling quality, chargeableness into the dispenser and the like. For example, two BIBs are juxtaposed within a refrigerator and are connected through tubes to peristaltic pumps, respectively, and the peristaltic pumps are connected through tubes to nozzles, respectively. On the other hand, the tank unit, for example, has two juxtaposed tanks which have different syrups accommodated therein, respectively, and to each of which the flow regulator and electromagnetic valve are connected through a tube. The flow regulator and electromagnetic valve are juxtaposed among the BIB and the side plate and top plate of the body.

In the united type-beverage dispenser like this, when the neutral or syrup drink is demanded by operating a switch disposed on the switch operation section, the neutral beverage raw material and the diluting water, or the syrup beverage are supplied into the cup from the corresponding nozzles.

However, according to the conventional united type-beverage dispenser, the flow regulator and electromagnetic valve of the tank unit are juxtaposed between the BIB and the side plate of the body, so that it is difficult to adjust the flow regulator and electromagnetic valve disposed close to the side plate of the body even through the BTB was removed. It is therefore required to adjust them by removing the top plate or side plate. Also, in order to sell two kinds of neutral beverages simultaneously, a relatively large table for placing two cups under the two nozzles is required, the downsizing of the entire tank unit can not be realized even through the downsizing of the STB unit was attempted. Further, when the nozzles for the neutral beverage and syrup beverage are centralized to dispose them in the center of the body, the tube downstream from the pump of the outer BIB unit becomes longer and thus, it is undesirable sanitarily. In addition, the arm of the peristaltic pump for the BIB unit is obstructive to the adjacent BIB unit in the opening and closing operations of the arm and thus, the narrowing of the intervals cannot be obtained thereby hindering the downsizing of the entire BIB unit.

It is therefore an object of the present invention to provide an united type-beverage dispenser in which a flow adjusting mechanism, an electromagnetic valve, and the like for a tank unit can be adjusted only by taking the BIBs out of a refrigerator without removing a top plate or side plate from the body of the dispenser.

It is another object of the present invention to provide an united type-beverage dispenser in which in the case where a plurality of BIB beverages are sold simultaneously, a plurality of cups can be juxtaposed on the table of the dispenser even though the BIB, a selling pump, and the like were downsized.

It is the other object of the present invention to provide an united type-beverage dispenser in which a neutral beverage and a syrup beverage can be provided from the centralized nozzles disposed in the center of the body and a lengthy tube downstream from a selling pump for the BIB unit is not required thereby enabling to provide a highly improved sanitized beverage dispenser.

It is the other object of the present invention to provide an united type-beverage dispenser in which the space for opening and closing of an arm to hold the tube can be secured even though the selling pump such as a peristaltic pump and the like was downsized, and the downsizing of the selling pump as well as the BIB can be promoted.

SUMMARY OF THE INVENTION

According to the present invention, an united type-beverage dispenser, comprises;

a tank unit which provides the first beverage by diluting a raw material supplied through a flow rate adjusting mechanism and a valve mechanism from a tank with drinking water; and at least two BIBs (Bag in Box) units which provide the second beverages by diluting respective raw materials supplied by respective pumps from at least two BIBs accommodated within a refrigerator with drinking water;

wherein the flow Late adjusting mechanism and the valve mechanism of the tank unit are centered within the refrigerator;

the at least two BIBs of the at least two BIB units are accommodated within and on both sides of the refrigerator; and when the at least two BIBs are taken out of the refrigerator, the flow rate adjusting mechanism and the valve mechanism can be adjusted from the space in which the at least two BIBs have been accommodated.

BRIEF DESCRIPTION OF THE DRAWINGS

The invention will be explained in detail in conjunction with appended drawings, wherein.

DESCRIPTION OF THE PREFERRED EMBODIMENTS

Before describing the united type-beverage dispenser in the preferred embodiments according to the present invention, the aforementioned conventional united type-beverage dispensers will be described in detail in FIGS. 1 to 3.

Figure 1:
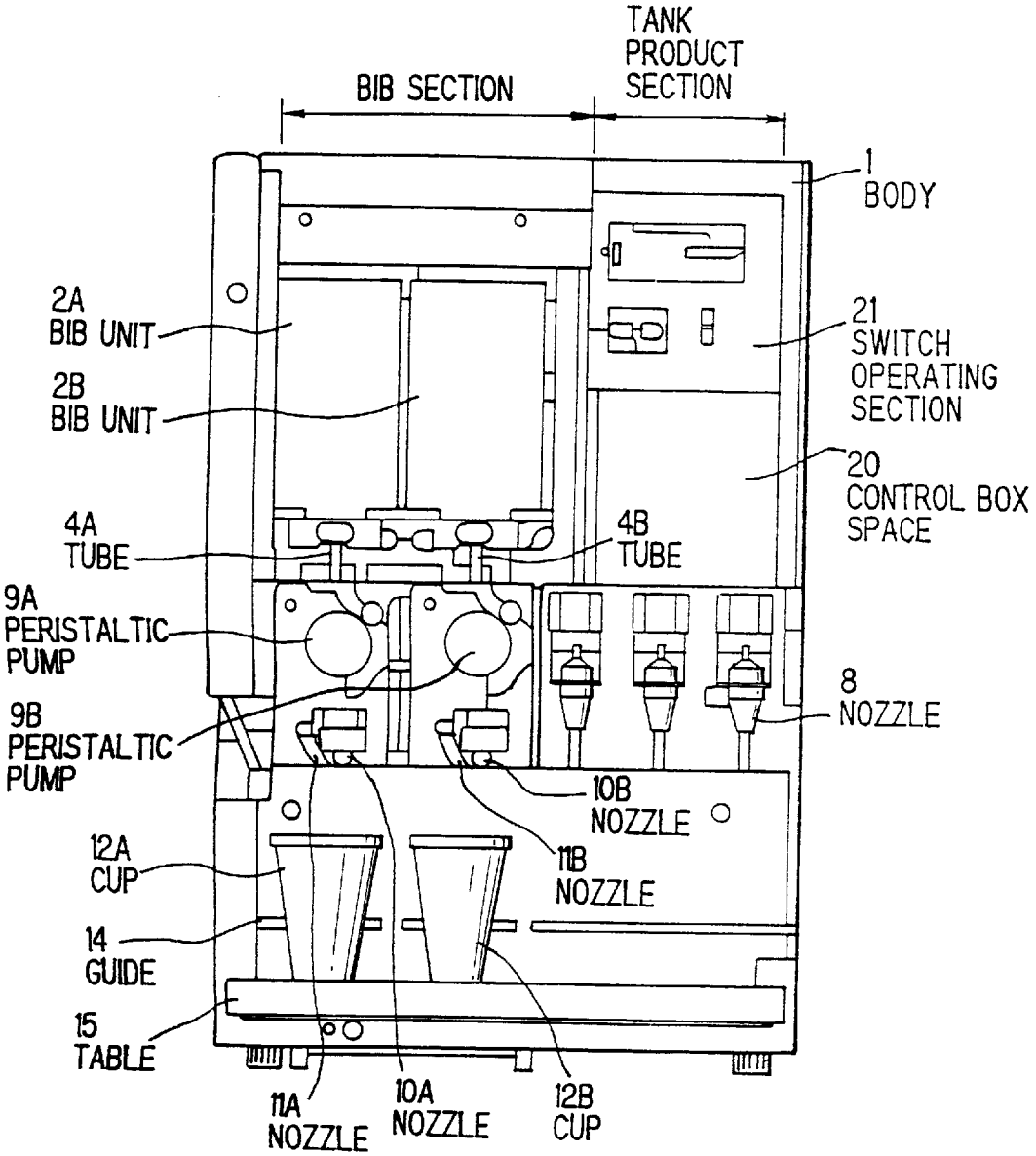
FIG.1 PRIOR ART
FIG. 1 is a front view showing a conventional united type-beverage dispenser.

FIG. 1 shows the conventional united type-beverage dispenser which has two BIB units to supply a neutral beverage such as oolong, a syrup beverage, etc., and a tank unit to supply a strong or weak carbonic acid syrup beverage to be united into one body 1. The BIB units 2A and 2B are accommodated within a refrigerator disposed within the body 1 of the dispenser. Tubes 4A and 4B for the BIB units 2A and 2B are held between the rotors of peristaltic pumps 9A and 9B and arms, respectively, and the raw materials for beverages to be pressure-fed by the peristaltic pumps 9A and 9B are supplied to nozzles 10A and 10B, respectively. For example, the pumps shown in FIG. 2 are used as the peristaltic pump)s 9A and 9B. Nozzles 11A and 11B for diluting water are disposed adjacent to the neutral beverage nozzles 10A and 10B. On the other hand, the tank unit (not shown) has a syrup channel comprising a tube connected to a syrup tank, a flow regulator having a flow rate control screw provided in the syrup channel, an electromagnetic valve, etc. This tank unit is disposed behind the switch operating section 21 and control box space 20 shown in FIG. 1 and to the nozzles 8 provided thereunder are connected electromagnetic valves (not shown) through tubes. A table 15 is provided under the nozzles 10A, 10B, 11A and 11B of the BIB units 2A and 2B, and the nozzles 8 of the tank unit, and cups 12A and 12B guided by guides 14 can be arranged on the table 15.

In operation of the conventional united type-beverage dispenser, when the switch in the switch operation section 21 is operated to demand a neutral beverage, the raw material of the corresponding beverage contained within the BIB 2A or 2B is pressure-fed to the nozzle 10A or 10B by the peristaltic pump 9A or 9B. On the other hand, a required amount of diluting water is pressure-fed to the nozzle 11A or 11B from the source of water supply connected to tap water by a water pump. The neutral beverage raw material and the diluting water supplied in this way are poured into the cup 12A or 12B to obtain the desired neutral beverage.

On the other hand, when the switch in the switch operation section 21 is operated to demand a syrup beverage, the syrup having a flow rate controlled by the flow regulator equipped with the flow rate adjusting screw is supplied through the opened electromagnetic valve to the mixer in the upstream of the nozzle 8. The syrup is mixed with the diluting water in the mixer to obtain a syrup beverage and the resulting syrup beverage is supplied into the cup (not shown).

Figure 2:
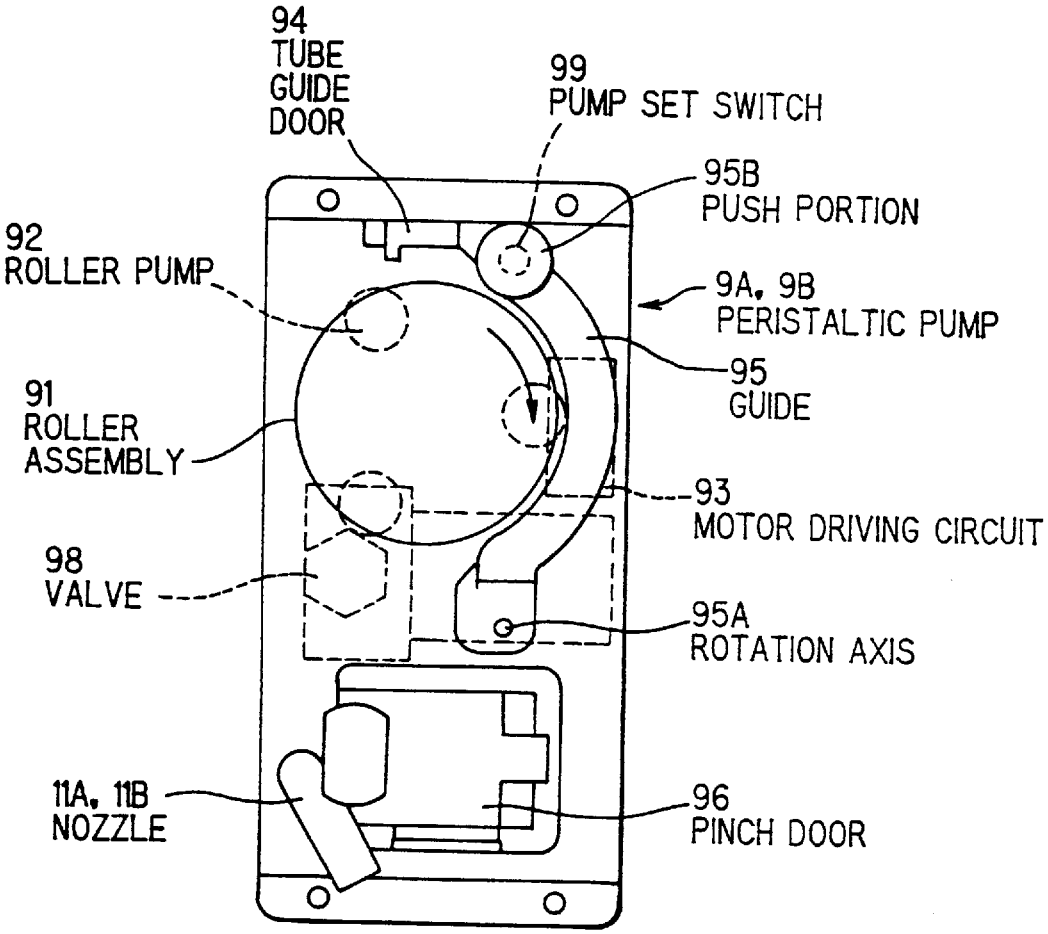
FIG.2 PRIOR ART
FIG. 2 is an explanatory view showing the peristaltic pump shown in FIG. 1.

FIG. 2 shows the peristaltic pumps 9A and 9B. The peristaltic pumps 9A and 9B comprise a roller assembly 91 which has three roller pumps 92 disposed on the peripheral side and can be rotated in the arrow direction, a motor driving circuit 93 to drive a stepping motor, a tube guide door 94 which can guide the tubes 4A and 4B toward the central direction of the roller assembly 91 by accommodating the tubes 4A and 4B therein, a guide (or arm) 95 which has a circular arc having the curvature equal to that of the roller assembly 91, is rotatably disposed around the rotation axis 95A and is secured to the roller assembly 91 to hold the tubes 4A and 4B, a pump set switch 99 which is pushed on by the push portion 95B of the guide 95 when the guide 95 is secured, a pinch door 96 which opens and closes the nozzles 10A and 10B of the tubes 4A and 4B by accommodating the tubes 4A and 4B therein, diluting water nozzles 11A and 11B to deliver the diluting water, and an electromagnetic valve 98 to control the diluting water delivered from the nozzles 11A and 11B.

In operation of the peristaltic pumps 91 and 92, when a neutral beverage is demanded, a driving signal having predetermined frequency pulses is generated by the motor driving circuit 93 to rotate the roller assembly 91 just to the given number of revolutions in the arrow direction, thereby the raw material within the tribes 4A or 4B is delivered by the roller pump 92.

Figure 3:
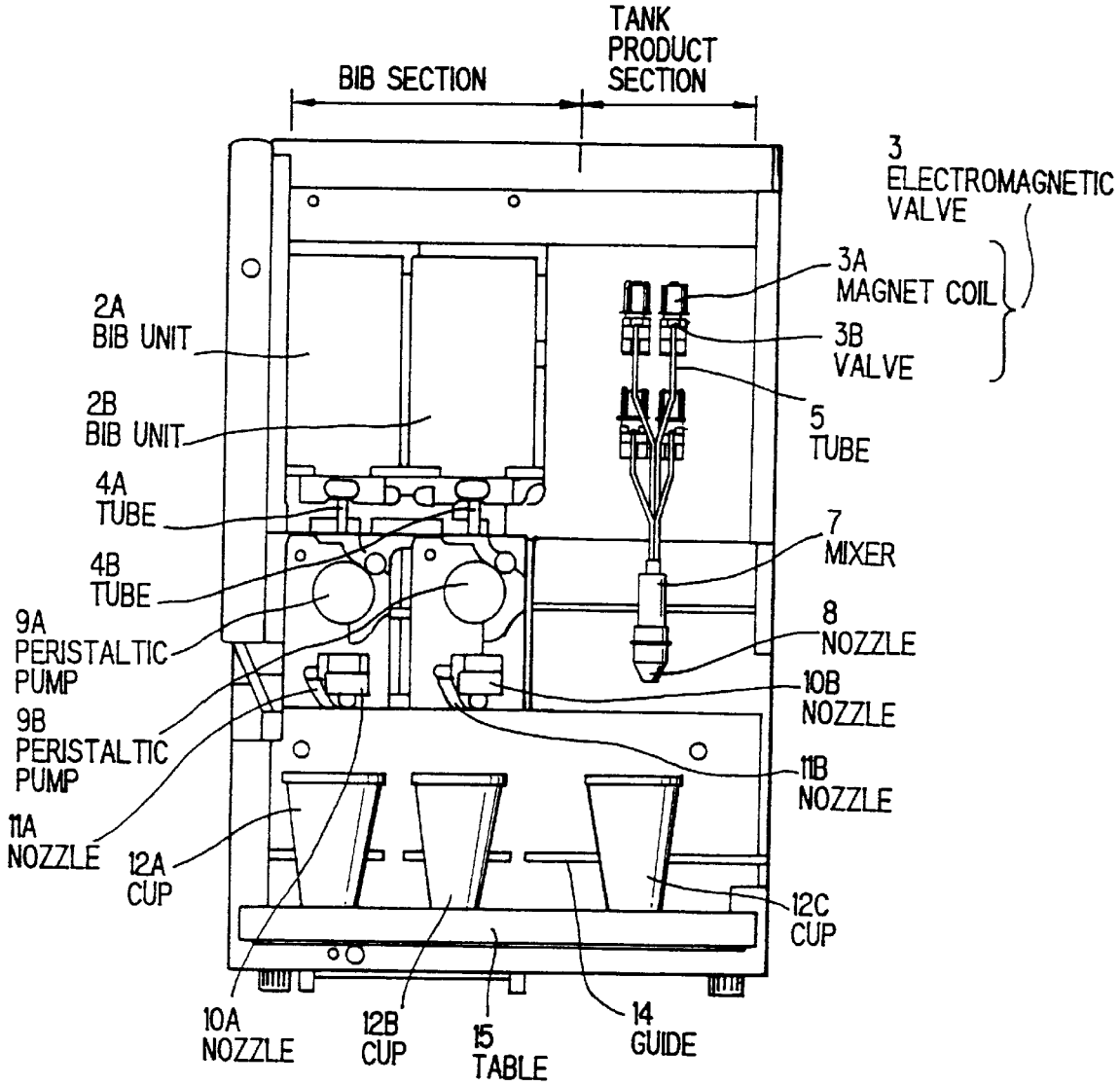
FIG.3 PRIOR ART
FIG. 3 is a front view showing another conventional united type-beverage dispenser.

FIG. 3 shows another conventional united type-beverage dispenser, in which the same components as shown in FIG. 1 are given the same numerals and thus the overlapped descriptions will be omitted. The part of the tank unit which was not shown in FIG. 1 is shown in FIG. 3 and the nozzles 8 shown in FIG. 1 are integrated into one nozzle 8 in FIG. 3. The tank unit shown here has an electromagnetic valve 3 consisting of a magnet coil 3A and a valve 3B which is opened or closed upon energizing or non-energizing the magnet coil 3A, a tube 5 to supply a syrup within a syrup tank by opening the electromagnetic valve 3, a mixer 7 to mix the syrup supplied through the tube 5 and the diluting water supplied through another tube to provide a syrup beverage, and a nozzle 8 to deliver the syrup beverage in the mixer 7. This nozzle 8 is a composite nozzle which can deliver a variety of syrup beverages supplied from plural syrup tanks according to the selection of a user.

Next, united type-beverage dispensers in the first and second preferred embodiments according to the present invention will be explained in FIGS. 4A, 4B and 5.

Figure 4A:
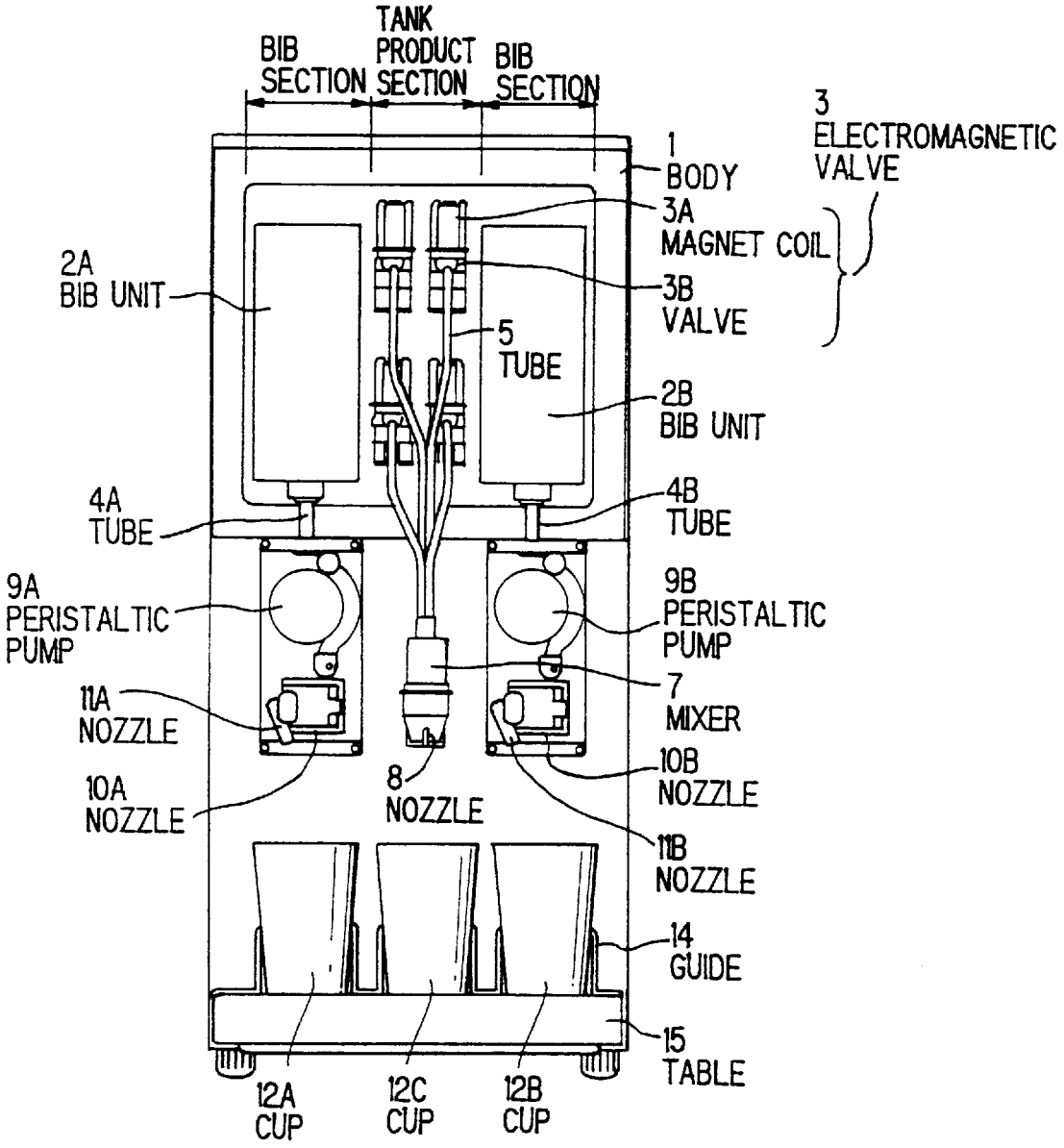
FIG. 4A is a front view showing a first preferred embodiment of an united type-beverage dispenser according to the present invention.
Figure 4B:
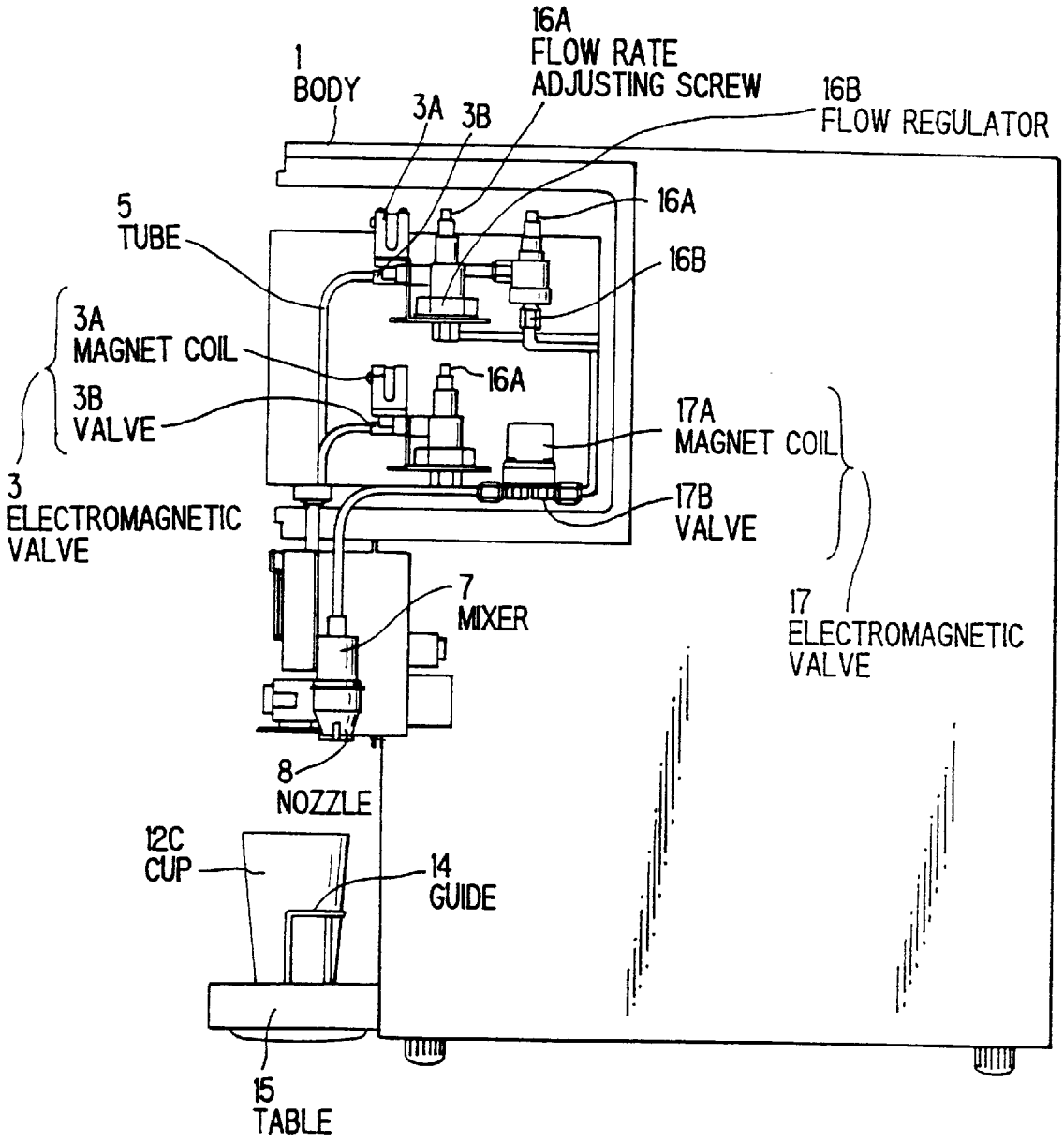
FIG. 4B is a side view showing the united type-beverage dispenser shown in FIG. 4A.

FIGS. 4A and 4B show the united type-beverage dispenser in the first preferred embodiment according to the present invention. As shown by terms, "tank product section" and "BIB section" in FIG. 4A, a tank unit is disposed in the center of the body 1 and a pair of BIB units are disposed on both sides of the tank unit. As the components common to in FIGS. 1 and 3 are shown by common numerals, the overlapped explanations will be omitted. In the case where the BIB units are downsized by downsizing BIBs 2A and 2B and the like, the BIB units are disposed on both sides of the tank unit and thus cups 12A and 12B can be juxtaposed on a table 15, thereby enabling the simultaneous sale of two kinds of neutral beverages. As shown in FIG. 3, the tank unit has a composite nozzle 8, so that two kinds of neutral beverages and one kind of syrup beverage can be old simultaneously by placing the cup 12C under the nozzle 8.

FIG. 4B shows the side of the tank unit. The syrup flow channel consisting of a tube 5 to supply a syrup has an electromagnetic valve 3 consisting of a magnet coil 3A and a valve 3B, and a flow regulator 16B having a flow rate adjusting screw 16A. Evidently from FIG. 4B, when the BIBs 2A and 2B are removed from the refrigerator, the side of the tank unit is opened and thus the flow rate adjusting screw 16A, the electro-magnetic valve 3, etc. can easily be adjusted. In order to adjust the flow rate adjusting screw 16A, it is therefore not necessary to remove the top plate and side plate of the body 1. An electromagnetic valve 17 to supply a given amount of diluting water has a magnet coil 17A and a valve 17B, like the electromagnetic valve 3. similarly, the electromagnetic valve 17 can easily be adjusted. Also, the space for opening and closing of an arm of peristaltic pumps 9A or 9B can easily be secured.

Figure 5:
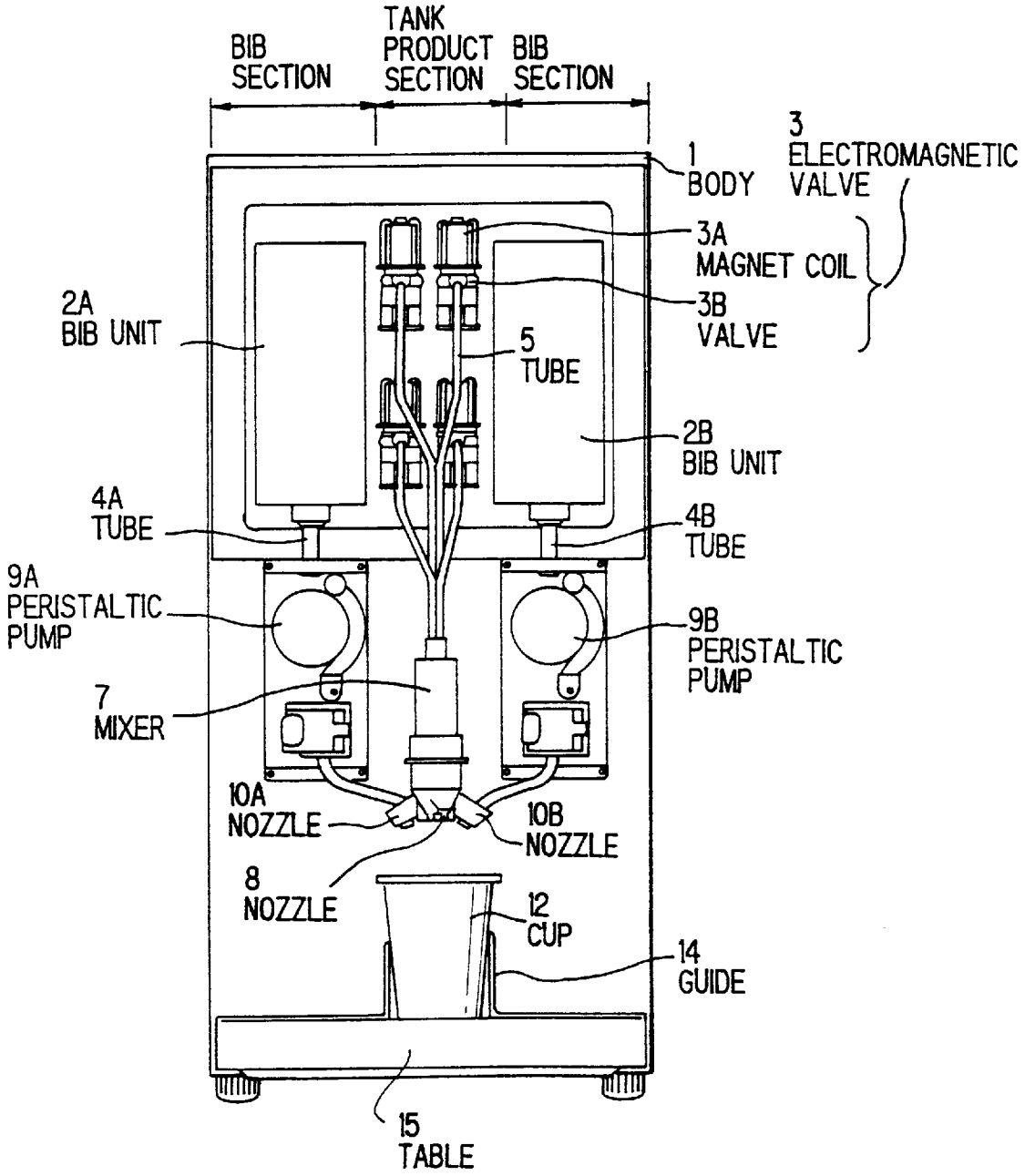
FIG. 5 is a front view showing a second preferred embodiment of an united type-beverage dispenser according to the present invention.

FIGS. 5 shows the united type-beverage dispenser in the second preferred embodiment according to the present invention, The same components as those shown in FIG. 1 are given the same numerals and thus the overlapped explanation will be omitted. This second preferred embodiment differs from the first preferred embodiment in the construction in which the nozzle 10A and 10B of BIB units, and the nozzle 8 of a tank unit are integrated into a centralized type nozzle. A cup 12 is placed under this centralized type nozzle. As shown in FIG. 5, even though adopting the centralized type nozzle, it is disposed in the center of the body 1 and thus it needs not to make the tubes downstream from the peristaltic pumps 9A and 9B of the BIB units so long. This is therefore superior to the conventional ones in sanitary respect.

Although the present invention has been described with respect to specific embodiments for complete and clear disclosure, the appended claims are not to be thus limited but are to be construed as embodying all modification and alternative constructions that may occur to those skilled in the art which fairly fall within the basic teaching herein set forth.

What is claimed is:

1. An united type-beverage dispenser, comprising;

a tank unit which provides a first beverage by diluting a raw material supplied through a flow rate adjusting mechanism and a valve mechanism from a tank with drinking water; and at least two BIBs (Bag in Box) units which provides second beverages by diluting respective raw materials supplied by respective pumps from at least two BIBs accommodated within a refrigerator with drinking water;

wherein said flow rate adjusting mechanism and said valve mechanism of said tank unit are centered within said refrigerator;

said at least two BIBs of said at least two BIB units are accommodated within and on both sides of said refrigerator; and when said at least two BIBs are taken out of said refrigerator, said flow rate adjusting mechanism and said valve mechanism can be adjusted from the space in which said at least two BIBs have been accommodated.

2. An united type-beverage dispenser, according to claim 1, wherein;

said tank unit has the first delivery means disposed in the center of the dispenser to deliver said first beverage; and said at least two BIB units have at least two second delivery means disposed on both sides of said first delivery means to deliver said second beverages.

3. An united type-beverage dispenser, according to claim 2, wherein;

said first and second delivery means are centralized to be disposed in the center of the dispenser.

4. An united type-beverage dispenser, according to claim 2, wherein;

said first delivery means has a mixer to mix said raw material supplied from said tank and said drinking water to produce said first beverage upstream; and each of said second delivery means has the third delivery means in combination therewith to deliver said drinking water used for diluting said raw materials supplied from said at least two BIBs disposed.

5. An united type-beverage dispenser, according to claim 1, wherein;

said tank accommodates a strong or weak carbonic acid as said raw material at a given pressure.

6. An united type-beverage dispenser, according to claim 1, wherein;

each of said at least two BIBs accommodates a raw material of neutral beverage as said raw material.

7. An united type-beverage dispenser, according to claim 2, wherein;

each of said at least two BIBs is connected to a corresponding one of said second delivery means by a tube to supply said raw material to said second delivery means by pressurizing said raw material with a peristaltic pump.

* * * * *